US008749469B2

(12) United States Patent
Iwamoto et al.

(10) Patent No.: US 8,749,469 B2
(45) Date of Patent: Jun. 10, 2014

(54) DISPLAY DEVICE FOR REDUCING PARASITIC CAPACITANCE WITH A DUMMY SCAN LINE

(75) Inventors: Akihisa Iwamoto, Osaka (JP); Hideki Morii, Osaka (JP); Takayuki Mizunaga, Osaka (JP); Masahiro Hirokane, Osaka (JP); Yuuki Ohta, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 922 days.

(21) Appl. No.: 12/734,932

(22) PCT Filed: Aug. 28, 2008

(86) PCT No.: PCT/JP2008/065449

§ 371 (c)(1),
(2), (4) Date: Jun. 3, 2010

(87) PCT Pub. No.: WO2009/093352

PCT Pub. Date: Jul. 30, 2009

(65) Prior Publication Data

US 2010/0238156 A1 Sep. 23, 2010

(30) Foreign Application Priority Data

Jan. 24, 2008 (JP) ..... 2008-014202

(51) Int. Cl.
*G09G 3/36* (2006.01)

(52) U.S. Cl.
USPC ..... 345/100; 345/98

(58) Field of Classification Search
USPC ..... 345/87–107
See application file for complete search history.

(56) References Cited

U.S. PATENT DOCUMENTS

| | | | | |
|---|---|---|---|---|
| 5,867,139 | A | 2/1999 | Tanaka et al. | |
| 5,877,736 | A | 3/1999 | Imajo et al. | |
| 6,172,661 | B1 | 1/2001 | Imajo et al. | |
| 7,394,443 | B2 * | 7/2008 | Baek et al. | 345/87 |
| RE40,771 | E | 6/2009 | Tanaka et al. | |
| 2001/0050678 | A1 | 12/2001 | Nishikubo et al. | |

(Continued)

FOREIGN PATENT DOCUMENTS

| | | |
|---|---|---|
| JP | 08-043793 | 2/1996 |
| JP | 08-076147 | 3/1996 |

(Continued)

OTHER PUBLICATIONS

Russian Notice of Allowance dated Aug. 16, 2011 and English translation thereof.
English version of ISR.
Abstract of JP 2003-337574 published Nov. 28, 2003.

*Primary Examiner* — Ryan A Lubit
(74) *Attorney, Agent, or Firm* — Harness, Dickey & Pierce, P.L.C.

(57) ABSTRACT

A display device, in at least one embodiment, includes: a gate driver including a plurality of shift register stages each provided so as to correspond to each row, the gate driver outputting a gate signal for turning on switching elements in the each row; and a source driver outputting a data signal in accordance with an image to be displayed. For a row (first row) located at an outermost position from which scanning by use of the gate signal starts, a dummy line is provided. The dummy line is driven by a gate start pulse inputted into a shift register in the first row.

2 Claims, 16 Drawing Sheets

(56) References Cited

U.S. PATENT DOCUMENTS

| | | | | |
|---|---|---|---|---|
| 2002/0033787 | A1 | 3/2002 | Park et al. | |
| 2002/0167026 | A1 | 11/2002 | Azami et al. | |
| 2004/0021650 | A1 | 2/2004 | Yamashita et al. | |
| 2004/0155851 | A1* | 8/2004 | Morii | 345/99 |
| 2006/0164587 | A1 | 7/2006 | Oh | |
| 2006/0202940 | A1 | 9/2006 | Azami et al. | |
| 2006/0256066 | A1* | 11/2006 | Moon | 345/100 |
| 2007/0132700 | A1* | 6/2007 | Cho et al. | 345/100 |
| 2007/0247932 | A1 | 10/2007 | Tobita et al. | |
| 2007/0262942 | A1* | 11/2007 | Choi | 345/98 |
| 2008/0012841 | A1 | 1/2008 | Morii | |
| 2009/0102824 | A1 | 4/2009 | Tanaka et al. | |

FOREIGN PATENT DOCUMENTS

| | | |
|---|---|---|
| JP | 09-288260 | 11/1997 |
| JP | 2002-189203 | 7/2002 |
| JP | 2002-335153 | 11/2002 |
| JP | 2004-085891 | 3/2004 |
| JP | 2005-272547 | 10/2005 |
| JP | 3882678 | 2/2007 |
| JP | 2007-317344 | 6/2007 |
| JP | 2007-317344 | 12/2007 |
| RU | 2 146 393 | 3/2000 |
| WO | WO 2007/105700 | 9/2007 |

* cited by examiner

-related art-

-related art-

-related art-

-related art-

-related art-

-related art-

-related art-

-related art-

-related art-

-related art-

-related art-

-related art-

-related art-

-related art-

DISPLAY DEVICE FOR REDUCING PARASITIC CAPACITANCE WITH A DUMMY SCAN LINE

TECHNICAL FIELD

The present invention relates to a matrix display device and a method for driving the matrix display device.

BACKGROUND ART

Commonly known matrix display devices are, for example, a liquid crystal display device including an active matrix substrate, on which TFTs (Thin Film Transistors) are formed, and driver ICs (Integrated Circuits) for driving the TFTs.

FIG. 6 illustrates a TFT active matrix liquid crystal display device 101. The liquid crystal display device 101 is provided with a gate driver 102 and a source driver 103. The gate driver 102 is a circuit for driving rows of a matrix, and the source driver 103 is, a circuit for driving columns of the matrix.

On a transparent substrate, a plurality of gate lines Gn, Gn+1, . . . (hereinafter denoted by a reference sign G, when collectively termed) and a plurality of source lines Sn, Sn+1, . . . (hereinafter denoted by a reference sign S, when collectively termed) are formed so as to orthogonally intersect with each other. The plurality of gate lines G are driven by the gate driver 102 and the plurality of source lines S are driven by the source driver 103. In a position at each of intersections of the gate lines G and the source lines S, a pixel PIX is provided. The pixel PIX includes a TFT 104, a liquid crystal 105, and a storage capacitor 106. In each of areas surrounded by the gate lines G and the source lines S, a pixel electrode 107 (FIG. 7) is formed. The pixel electrode 107 serves as one electrode of the liquid crystal 105 and one electrode of the storage capacitor 106, and is connected to a drain electrode of the TFT 104. In a pixel PIX in an n-th row and in an n-th column, a source electrode of the TFT 104 is connected to a source line Sn in the n-th column, and a gate electrode of the TFT 104 is connected to a gate line Gn in the n-th row.

When a relationship between the gate lines and the pixel electrodes 107 is spotlighted in the liquid crystal display device 101 in which the pixels PIX are thus formed, it is recognized that the liquid crystal display device 101 in FIG. 6 is a so-called below-pixel-electrode gate type liquid crystal display device in which the gate line Gn in the n-th row is provided below the pixel electrode 107 in the n-th row. Further, as illustrated in FIG. 7, between the pixel electrode 107 and the gate line Gn and between the pixel electrode 107 and the gate line Gn−1, parasitic capacitances Cgd1 and Cgd2 are generated, respectively. In regard to the pixels in the first row, a gate line G0, which corresponds to the foregoing gate line Gn−1 for the pixels PIX in the n-th row, is not provided, so that a parasitic capacitance corresponding to the foregoing parasitic capacitance Cgd2 is not generated. FIG. 6 illustrates a difference between an equivalent circuit of a pixel in the first row (line G1) in which the parasitic capacitance Cgd2 is not generated and an equivalent circuit of a pixel in each of the second and subsequent rows (Gn (n≠1)) in which both the parasitic capacitances Cgd1 and Cgd2 are generated.

In the meantime, as illustrated in FIG. 8, a gate signal having an amplitude of Vgpp is sequentially applied to each gate line G. This gate signal varies a drain level of the TFT 104. That is, in each of the pixels PIX in the n-th row, via the parasitic capacitance Cgd2, the gate signal of the gate line Gn−1 varies the drain level of the TFT 104 by ΔV2, and via the parasitic capacitance Cgd1, the gate signal of the gate line Gn varies the drain level of the TFT 104 by ΔV1. Here, provided that the capacitance of the liquid crystal of the pixel PIX is denoted by Clc and the storage capacitance is denoted by Ccs, the above-mentioned ΔV2 and ΔV1 can be expressed as follows:

$$\Delta V1 = Vgpp \times \{Cgd1/(Clc+Ccs+Cgd1+Cgd2)\}$$

$$\Delta V2 = Vgpp \times \{Cgd2/(Clc+Ccs+Cgd1+Cgd2)\}$$

The ΔV1 produced by the gate signal of the gate line Gn of the n-th stage causes a center value Vcom of an amplitude of the drain level of the TFT 104 to be lower than a center value Vsc of an amplitude of a source signal by ΔV1. The ΔV2 produced by the gate signal of the gate line Gn−1 of the preceding stage raises an effective value of a voltage applied to the liquid crystal 105.

As described above, each of the pixels PIX in the first row is not provided with the gate line G0 that is a preceding stage which forms the parasitic capacitance. Cgd2. For this reason, the ΔV2 does not occur. Consequently, the effective value of the voltage applied to the liquid crystal 105 only in the pixels PIX in the first row becomes lower than the effective values supplied to the respective pixels PIX of the remaining rows. Due to this difference of the effective values, brightness of the pixels PIX only in the first row appears different in display from brightness of the remaining pixels PIX in a case where a driving condition of the display device deteriorates, for example, in a case where the value ΔV2 is large or in a case where a temperature becomes too high or low. For instance, when normally white liquid crystal is adopted, the first line appears a bright line.

In order to solve the above problem, various techniques have been conventionally proposed. For example, Patent Literature 1 discloses a liquid crystal display device in which a below-pixel-electrode gate type panel is provided with a dummy gate line (dummy line G0) in the vicinity of pixels of the first row. This dummy gate line is not involved in displaying but compensates the aforementioned asymmetry between the pixels of the first row and the remaining pixels. FIG. 9 is a circuit diagram illustrating a configuration of the liquid crystal display device according to Patent Literature 1. FIG. 10 is a timing chart of signals inputted into the dummy line and the gate lines of the liquid crystal display device of Patent Literature 1.

As shown in FIG. 9, in the liquid crystal display device of Patent Literature 1, the dummy line G0 for producing capacitances is arranged on an outer side of a gate line (i.e., in the example shown in FIG. 9, a top gate line) G1 located at an outermost position from which scanning by use of a scanning signal starts. The dummy line G0 is arranged to be parallel to the gate line G1, and to face the gate line G1 so that a pixel electrode 6 connected to a TFT 5 connected to the gate line G1 is between the dummy line G0 and the gate line G1.

With this configuration, the pixel electrode 6 connected to the TFT 5 connected to the top gate line G1 is located between the dummy line G0 above and the gate line G1 below. Consequently, all of the pixels are geometrically symmetrical in a vertical direction. Therefore, the pixels driven by the top gate line G1 have completely the same conditions as the pixels driven by the other gate lines G2, G3, . . . . Consequently, in a case of a normally white liquid crystal, for example, it is possible to restrain such a conventional phenomenon that a line of pixels in the top row appears a bright line or the like.

However, the above conventional technique 1 has a problem in that it is necessary to provide a dummy line. This results in an increase in the number of wirings and accordingly an increase in the circuit area. This is against a recent trend of decreasing cost, weight and thickness of liquid crystal displays.

In the meantime, Patent Literature 2 discloses a method according to which a dummy line G0 driving signal is generated in a mode in which display timing is controlled by a data enable signal in a liquid crystal display device. FIG. 11 is a plane view schematically illustrating a configuration of a gate driver of the liquid crystal display device according to Patent Literature 2. FIG. 12 is a timing chart of signals that are involved in timing control.

As illustrated in FIG. 11, a liquid crystal display panel 3 of the liquid crystal display device includes 768 gate lines G1, G2, . . . , and G768 connected to respective effective pixels. Furthermore, a dummy line G0, which serves as a dummy gate line, is provided in a stage preceding the gate line G1. In order to drive these 769 gate lines, a gate driver 2 includes cascade-connected three driver ICs each of which has 258 output terminals.

In the above configuration, a control IC generates a gate start pulse signal GSP and a gate clock signal GCK based on a data enable signal ENAB and a clock signal CK, respectively, with reference to timing of inputting the data enable signal ENAB. Then, the control IC supplies these generated signals to the gate driver 2 so that, before a source driver starts to output a write signal corresponding to display data of the first horizontal period in one vertical period, the gate driver 2 outputs a gate signal to a top output terminal OG0. Thus, on the occasion of performing display in the data enable mode, it is possible to drive the dummy line G0 before the write signal of the first horizontal period is outputted to a source line S.

In this way, the liquid crystal display device of Patent Literature 2 uses only the data enable signal but does not use horizontal and vertical synchronization signals, for generating liquid crystal driving signals. In consequence, it is possible to reduce the number of wirings for input signals.

CITATION LIST

Patent Literature 1

Japanese Patent Application Publication, Tokukaihei, No. 9-288260 A (Publication Date: Nov. 4, 1997)

Patent Literature 2

Japanese Patent Application Publication, Tokukai, No. 2004-85891 A (Publication Date: Mar. 18, 2004)

Patent Literature 3

Japanese Patent Application Publication, Tokukai, No. 2002-189203 A (Publication Date: Jul. 5, 2002)

SUMMARY OF INVENTION

In the technique of Patent Literature 2, a driving pulse of the dummy line G0 is generated in a period from the input of the data enable signal ENAB to output of a driving pulse of the gate line G1. Therefore, as shown in FIG. 12, a pulse width of the driving pulse of the dummy line G0 becomes narrower than a pulse width of each of driving pulses of the gate line G1 and the subsequent gate lines. For this reason, it is not possible to adequately charge the pixels on the dummy line G0. As a result, the dummy line cannot provide an adequate effect as a dummy line.

In view of this problem, Patent Literature 3 discloses a configuration of a dummy signal generation circuit that generates a pulse for driving a dummy line G0. FIG. 13 is a circuit diagram illustrating a configuration of the dummy signal generation circuit. FIG. 14 is a timing chart of various signals that are relevant to the dummy signal generation circuit.

According to the configuration of this dummy signal generation circuit, generation of an A signal for driving the dummy line G0 precedes, by one horizontal period, generation of a GSP signal. This makes it possible for the signal applied to the dummy line G0 to have the same pulse width as the signals applied to the other gate lines. In consequence, all of the pixels can have the same charging characteristics. The technique disclosed in Patent Literature 3 can thus solve the problem arising from the influence of the pulse width as set forth in Patent Literature 2.

However, in the technique of Patent Literature 3, output of gate pulses subsequent to the GSP signal is delayed. On this account, the technique of Patent Literature 3 requires a line memory for delaying output of data signals. That is, the problem of cost increase remains unsolved. Moreover, additional problems, such as an increase of power consumption, arise.

In recent years, liquid crystal display devices are strongly required not only to have a better display quality but also to achieve reduced cost and power consumption. From this point of view, the technique disclosed in Patent Literature 3 is not necessarily sufficient.

One technique for reducing cost of liquid crystal displays is monolithic integration of a gate driver. With this technique which has been adopted in recent years, the gate driver is formed on a display panel with use of amorphous silicon. FIG. 15 illustrates an example of a configuration of a shift register constituting a gate driver formed by monolithic integration. FIG. 16 is a circuit diagram of shift register stages constituting a shift register, and FIG. 17 is a timing chart illustrating waveforms of various signals in the shift register stages.

The gate driver formed by monolithic integration includes a shift register including a plurality of shift register stages 31 cascade-connected. An output terminal out of each shift register stage 31 is connected to a set input terminal set of a subsequent shift register stage 31 and a reset input terminal reset of a preceding shift resister stage 31. That is, an output signal SRout outputted from the output terminal out of each shift register stage 31 serves as a set signal for the subsequent shift register stage 31 and a reset signal for the preceding shift register stage 3*a*. Note that, as shown in FIG. 16, for example, each shift register stage 31 includes a plurality of transistors T1 to T4 and a capacitor C1.

In a case where a gate driver is thus configured by the monolithic integration, it is common that a potential of a node n1 is boosted for restraining a decrease in a potential level of the output signal SRout due to a fall in a threshold of a transistor. On this account, as shown in the timing chart of FIG. 17, prior to output of the output signal SRout, an output signal SRoutn−1 of the preceding shift register stage 31 is inputted as a set signal.

In such a gate driver, for the purpose of preventing the aforementioned problem of a bright line, a dummy line G0 may be provided, as illustrated in FIG. 18. In such a case, it is necessary to generate a signal at a timing prior to output to the dummy line G0 (FIG. 19). Accordingly, when, e.g., the technique of Patent Literature 2 is adopted, it is necessary to further shorten the pulse width of the signal for driving the dummy line G0. Consequently, it becomes more difficult to charge pixels of the dummy line G0. As a result, the dummy line G0 cannot provide an effect as a dummy line G0. This makes it impossible to reliably restrain the problem of a bright line. Furthermore, the potential of the node n1 in the shift register 31 for the dummy line G0 cannot be adequately boosted, because the time period for boosting the potential is shortened. As such, it becomes impossible to obtain an output signal of a desired potential level, which may lead to a malfunction.

As described above, though the conventional techniques can reduce an influence of the occurrence of a bright line by providing a dummy line, the provision of the dummy line produces various problems. In other words, according to the conventional techniques, it is difficult to restrain deterioration of display quality due to the bright line without causing problems such as an increase in cost and circuit area.

The present invention is accomplished in view of the above conventional problems, and an object of the present invention is to provide, by equalizing the parasitic capacitances generated in each pixel but causing no increase in cost and circuit area, a display device that can prevent display quality from deteriorating due to, for example, a bright line caused by pixels of a particular section or the like, and a method for controlling the display device.

In order to attain the above object, a display device according to the present invention is a display device which includes: a display panel including: scanning signal lines; data signal lines; pixel electrodes; and switching elements, and in the display panel, each of the switching elements has (i) one terminal connected with one of the pixel electrodes and (ii) another terminal connected with one of the data signal lines, each of the scanning signal lines turns on/off switching elements corresponding thereto, the each scanning signal line forms one of rows together with the switching elements connected thereto, and pixel electrodes respectively connected to these switching elements, a scanning signal line driving circuit including a plurality of shift registers each provided so as to correspond to each of the rows, the scanning signal line driving circuit outputting a scanning signal for turning on the switching elements in the each row; a data signal line driving circuit outputting a data signal in accordance with an image to be displayed; and a dummy scanning signal line provided for an outermost row located at an outermost position from which scanning by use of the scanning signal starts, and in the display device according to the present invention, the dummy scanning signal line is driven by a gate start pulse inputted into a shift register corresponding to the outermost row located at the outermost position.

Note that, in a typical configuration of a liquid crystal display device, in many cases, the terms "row" and "horizontal" express a sequence in a lateral direction of a display panel and the terms "column" and "vertical" express a sequence in a longitudinal direction of a display panel. However, the definitions are not necessarily limited thereto, and the lateral and longitudinal directions in the definitions may be reversed. As such, in the present invention, the terms "row", "column", "horizontal", and "vertical" do not particularly limit directions.

According to the above configuration, a dummy scanning signal line is provided for a row located at the outermost position from which scanning by use of the scanning signal starts. As a result, in each of the pixels in the row corresponding to the scanning signal line G1 located at the outermost position from which the scanning starts, parasitic capacitances are produced by the scanning signal line G1 and the dummy scanning signal G0. Consequently, the pixels driven by the scanning signal line G1 have completely the same conditions as the pixels driven by the other scanning signal lines G2, G3, . . . , which makes it possible to equalize the parasitic capacitances produced in each of the pixels. As such, in a case of a normally white mode, for example, it is possible to reduce such a phenomenon that a line of pixels at the outermost position appears a bright line.

Moreover, according to the above configuration, the dummy scanning signal line is driven by the gate start pulse inputted into the shift register corresponding to the row located at the outermost position. That is, the gate start pulse is not only inputted into the first shift register but also used to drive the dummy scanning signal line G0. The use of one same signal in this way can make it possible to use the dummy scanning signal line G0 also as the gate start pulse line. As such, the number of wirings can be reduced in comparison with the conventional techniques. In addition, it becomes unnecessary to provide a shift register corresponding to the dummy scanning signal line G0. This also makes it possible to achieve reduction in cost and circuit area.

Furthermore, according to the above configuration, the gate start pulse can be used as a driving signal for both the first shift register and the dummy scanning signal line G0. As such, unlike a case where the conventional data enable mode is adopted, it is not necessary to shorten a pulse width of the signal for driving the dummy scanning signal line G0. This makes it possible to sufficiently charge the pixels corresponding to the dummy scanning signal line G0, and therefore to attain a more even display.

As described above, with the configuration of the present invention, it is possible to equalize the parasitic capacitances generated in each of the pixels without causing an increase in cost and circuit area. As a result, the present invention provides an effect of restraining deterioration of display quality due to, for example, a bright line that is caused by the pixels in a particular section.

The display device according to the present invention may preferably be the display device in which the dummy scanning signal line is arranged so as to sandwich pixel electrodes in the outermost row between the dummy scanning signal line and a scanning signal line in the outermost row so that a distance between the dummy scanning signal line and the scanning signal line in the outermost row is equal to a distance between other two adjacent scanning signal lines, and the outermost row is located at the outermost position.

According to this configuration, the pixels in the row corresponding to the scanning signal line G1 located at the outermost position from which the scanning starts is sandwiched between the dummy scanning signal line G0 above and the scanning signal line G1 below. That is, all of the pixels are geometrically symmetrical in a vertical direction. Therefore, the pixels driven by the scanning signal line G1 can have completely the same conditions as the pixels driven by the other scanning signal lines G2, G3, . . . . Consequently, it is possible to reliably equalize the parasitic capacitances produced in each of the pixels. This makes it possible to reliably restrain deterioration of display quality.

The display device according to the present invention may preferably be arranged such that the gate start pulse driving the dummy scanning signal line has a voltage level allowing the switching element to be turned on/off.

It is preferable that the gate start pulse driving the dummy scanning signal line is set at the voltage level by a buffer.

With the above configuration, it is possible to make the voltage level of the signal for driving the dummy line G0 the same as the voltage level of the signal (scanning signal) for driving the other scanning signal lines G2, G3, . . . . Therefore, the pixels driven by the scanning signal line G1 can have completely the same conditions as the pixels driven by the other scanning signal lines G2, G3, . . . . This can restrain such a phenomenon that a line of pixels appears a bright line or the like, thereby restraining deterioration of display quality. Furthermore, because it is possible to generate the gate start pulse by a buffer, the display device of the present invention can be realized in a simple configuration.

The display device according to the present invention is preferably the display device which further includes: a control device generating the gate start pulse and a clock for driving the scanning signal line driving circuit, and the control device includes the buffer for generating the gate start pulse.

With this configuration, it is possible to generate, by the buffer included in the control device, the gate start pulse which drives the dummy scanning signal line G0 and the first shift register. Therefore, the effect as described above can be achieved without complicating the configuration.

In addition, it is possible to apply the above configuration to a monolithically-integrated gate driver, because the gate start pulse can be inputted from an external control device. This can further reduce cost for the display device.

It is preferable that, in the display device according to the present invention, the dummy scanning signal line is connected to a signal line connecting the control device with the scanning signal line driving circuit; and the gate start pulse is inputted into the scanning signal line driving circuit and the dummy scanning signal line via the signal line.

With this configuration, the gate start pulse outputted from the control device directly drives the dummy scanning signal line G0, and the same gate start pulse is inputted into the first shift register as a gate start pulse for the first shift register. Thus, the dummy scanning signal line G0 can be used also as the signal line (gate start pulse line) that connects the control device with the scanning signal line driving circuit. As a result, the number of wirings can be reduced.

In order to attain the above object, a method for driving a display device according to the present invention is a method for driving a display device which includes a display panel including: scanning signal lines; data signal lines; pixel electrodes; and switching elements, and in the display panel, each of the switching elements has (i) one terminal connected with one of the pixel electrodes and (ii) another terminal connected with one of the data signal lines, each of the scanning signal lines turns on/off the switching elements corresponding thereto, and the each scanning signal line forms one of rows together with the switching elements connected thereto, and pixel electrodes respectively connected to these switching elements, and the method according to the present invention includes the steps of: driving the scanning signal line by outputting a scanning signal for turning on the switching elements in each of the rows; driving a data signal line by outputting a data signal in accordance with an image to be displayed; and driving, by use of a gate start pulse, a dummy scanning signal line provided for a row located at an outermost position from which scanning by use of the scanning signal starts, and the gate start pulse is inputted into a shift register corresponding to the row located at the outermost position.

Similarly to the effect of the display device as described above, this method restrains deterioration of display quality due to the occurrence of a bright line or the like.

The display device according to the present invention is arranged as described above such that a dummy scanning signal line is provided for the row located at the outermost position from which scanning by use of the scanning signal starts and that the dummy scanning signal line is driven by the gate start pulse inputted into the shift register corresponding to the row located at the outermost position.

The method for driving a display device according to the present invention is to drive the dummy scanning signal line provided for the row located at the outermost position from which scanning by use of the scanning signal starts, by the gate start pulse inputted into the shift register corresponding to the row located at the outermost position.

Therefore, the present invention makes it possible to equalize the parasitic capacitances generated in each of the pixels but to cause no increase in cost and circuit area, thereby achieving an effect of restraining deterioration of display quality due to, for example, a bright line caused by pixels in a particular section.

REFERENCE SIGNS LIST

1 Liquid Crystal Display Device (Display Device)
10 Liquid Crystal Display Panel (Display Panel)
11 TFT (Switching Element)
12 Pixel Electrode
20 Source Driver (Data Signal Line Driving Circuit)
30 Gate Driver (Scanning Signal Line Driving Circuit)
31 Shift Register Stage (Shift Register)
40 Control Device
41 Timing Control IC
42 Level Shifter
43 Buffer
Sn Source Line (Data Signal Line)
Gn Gate Line (Scanning Signal Line)
G0 Dummy Line (Dummy Scanning Signal Line)
GSP Gate Start Pulse
SR Shift Register
CKA, CKB Clock Signals

DESCRIPTION OF EMBODIMENTS

In the following, an embodiment of the present invention is described with reference to FIGS. 1 to 5.

Figure 1:
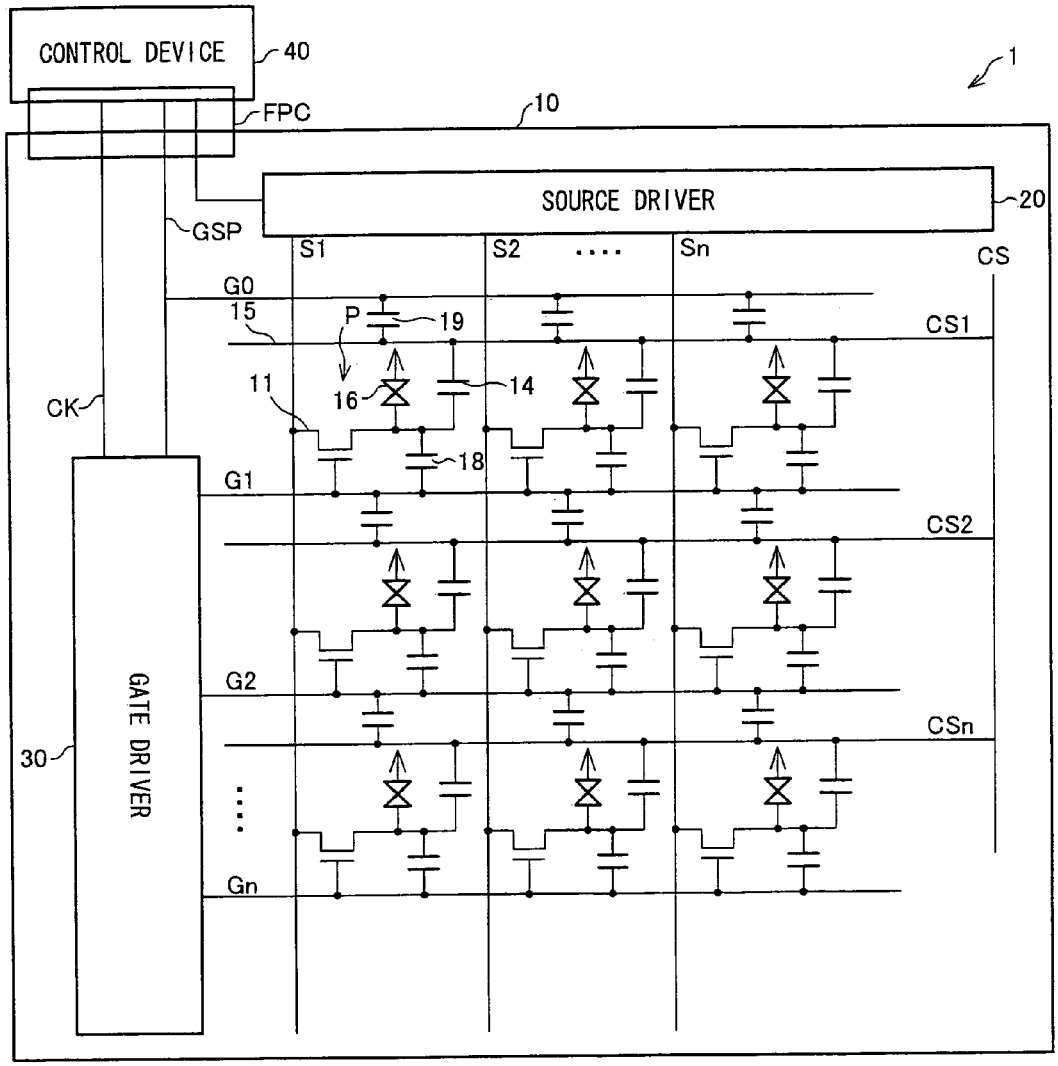
FIG. 1 is a block diagram illustrating an entire configuration of a liquid crystal display device according to the present invention.
Figure 2:
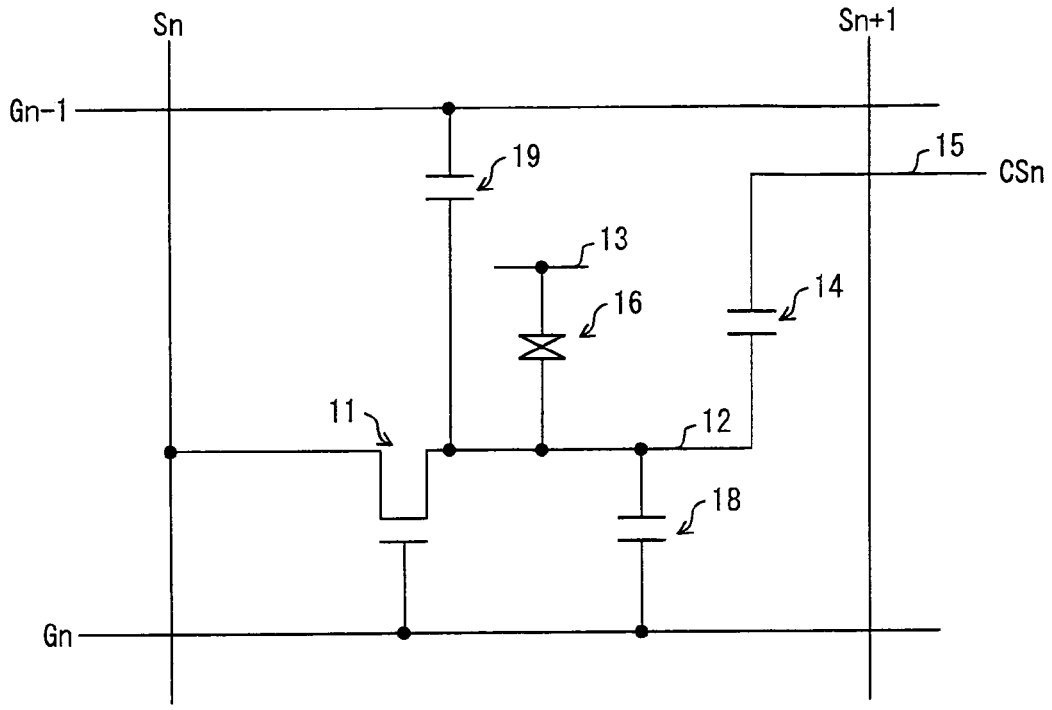
FIG. 2 is an equivalent circuit diagram illustrating an electrical configuration of a pixel of the liquid crystal display device illustrated in FIG. 1.

First, with reference to FIGS. 1 and 2, the following describes a configuration of a liquid crystal display device 1 which corresponds to a display device of the present invention. FIG. 1 is a block diagram illustrating an entire configuration of the liquid crystal display 1. FIG. 2 is an equivalent circuit diagram illustrating an electrical configuration of a pixel of the liquid crystal display device 1. Note that, in a configuration of a liquid crystal display device, in many cases, the terms "row" and "horizontal" express a sequence in a lateral direction of a display panel and the terms "column" and "vertical" express a sequence in a longitudinal direction of a display panel. However, the definitions are not necessarily limited thereto, and the lateral and longitudinal directions in the definitions may be reversed. As such, in the present invention, the terms "row", "column", "horizontal", and "vertical" do not particularly limit directions.

The liquid crystal display device 1 includes an active matrix liquid crystal display panel (display panel) 10, a source driver (data signal line driving circuit) 20, a gate driver (scanning signal line driving circuit) 30, and a control device 40.

The liquid crystal display panel 10 is configured such that liquid crystals are sandwiched between an active matrix substrate and a counter substrate (both not shown). Further, the liquid crystal display panel 10 is provided with a number of pixels P arranged in rows and columns.

The liquid crystal display panel 10 includes, on the active matrix substrate, source lines Sn corresponding to data signal lines of the present invention, gate lines Gn corresponding to scanning signal lines of the present invention, thin film transistors (hereinafter referred to as TFTs) 11 corresponding to switching elements of the present invention, and pixel electrodes 12 corresponding to pixel electrodes of the present invention. The liquid crystal display panel 10 also includes, on the counter substrate, a common electrode 13. Furthermore, the liquid crystal display panel 10 is provided with CS lines 15 for forming storage capacitors 14.

One of the source lines Sn is formed in each of the columns so as to be parallel to each other in a column (longitudinal) direction. One of the gate lines Gn is formed in each of the rows so as to be parallel to each other in a row (lateral) direction. One of the TFTs 11 and one of the pixel electrodes 12 are provided so as to correspond to each of intersections of the source bus lines Sn and the gate lines Gn. A source electrode of each TFT 11 is connected to the source line Sn. A gate electrode of each TFT 11 is connected to the gate line Gn, and a drain electrode of each TFT 11 is connected to corresponding one of the pixel electrodes 12. In addition, each pixel electrode 12 and the common electrode 13 sandwiches a liquid crystal and forms a liquid crystal capacitor 16.

With this configuration, the gate of the TFT 11 is turned on by a gate signal (scanning signal) supplied to the gate line Gn, and a source signal (data signal) from the source line Sn is written into the pixel electrode 12 so that the pixel electrode 12 is set at a potential corresponding to the source signal. Further, a voltage corresponding to the source signal is applied to the liquid crystal which intervenes between the pixel electrode 12 and the common electrode 13. This makes it possible to achieve a gray scale display corresponding to the source signal.

One of the CS lines 15 is formed in each of the rows so as to be parallel to each other in a row (lateral) direction and paired with a corresponding gate line Gn. Each CS line 15 is capacitively-coupled with each corresponding pixel electrode 12 that is provided in one of the rows. Thereby, each CS line 15 and each corresponding pixel electrode 12 form a storage capacitor 14.

Due to a structure of each TFT 11, parasitic capacitors (Cgd1 and Cgd2) 18 and 19 are formed between the gate electrode and the drain electrode. Consequently, a potential of the pixel electrode 12 experiences an influence (feed-through phenomenon) from a potential change of the gate line.

The liquid crystal display panel 10 as arranged above is driven by the source driver 20, the gate driver 30, and a control device 40 controlling the source driver 20 and the gate driver 30.

In the present embodiment, horizontal scanning periods are sequentially allocated to the respective rows in an active period (effective scanning period) of a vertical scanning period that is periodically repeated, so that the rows are sequentially scanned.

Therefore, the gate driver 30 sequentially outputs a gate signal for turning on TFTs 11 to a corresponding gate line Gn in synchronization with a horizontal scanning period of each row. A specific configuration of the gate driver 30 will be described later.

In the meantime, the source driver 20 outputs a source signal to each of the respective source lines Sn. The source signal is a signal obtained from a video signal which has been supplied to the source driver 20 via the control device 40 and which the source driver 20, for example, allocates to each of the columns and subjects to a process for raising a voltage. The configuration of the source driver 20 is not particularly limited, and a conventional common structure may be employed.

The control device 40 controls the source driver 20 and the gate driver 30 so as to cause these circuits to output desired signals, respectively. A specific configuration of the control device 40 will be described later.

Figure 6:
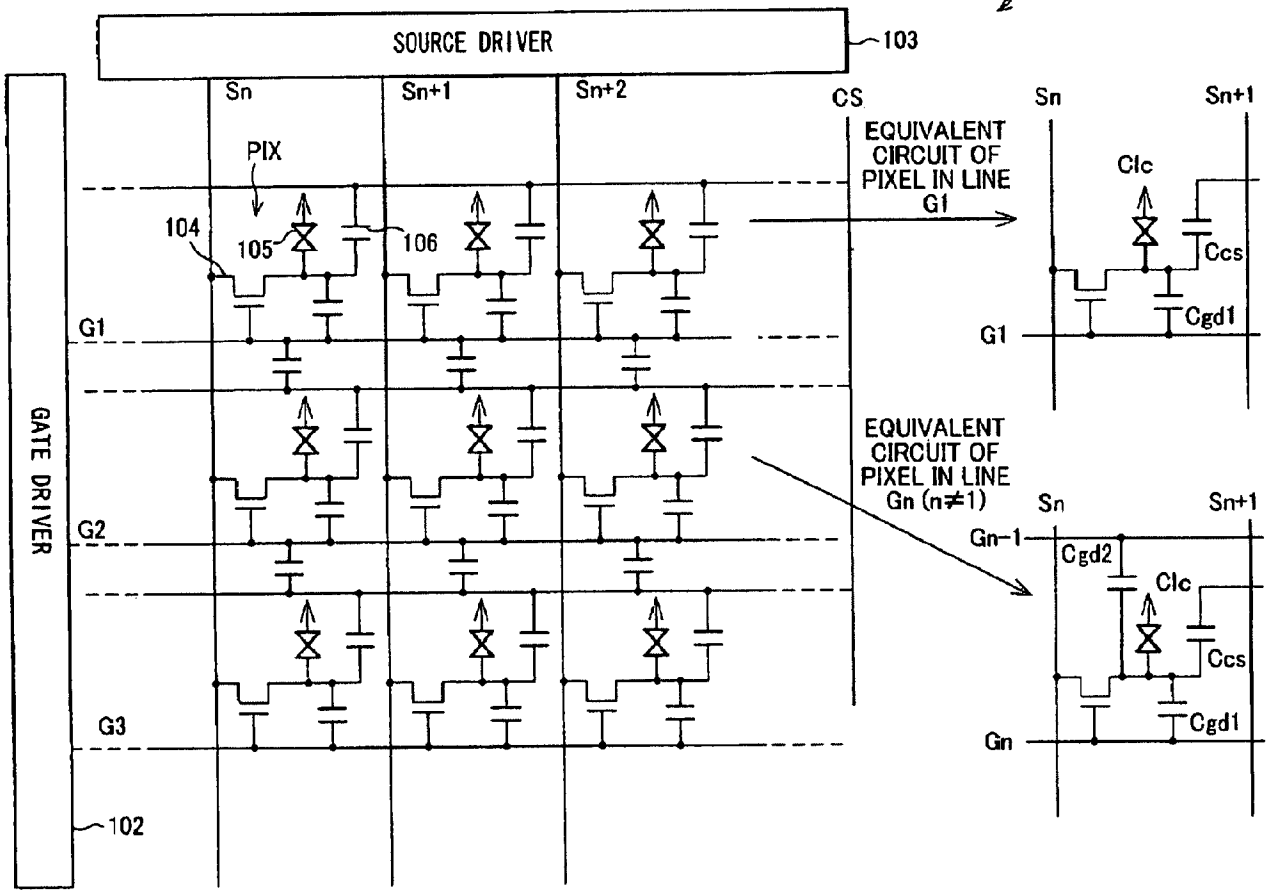
FIG. 6 is a block diagram illustrating an entire configuration of a conventional TFT active matrix liquid crystal display device.
Figure 7:
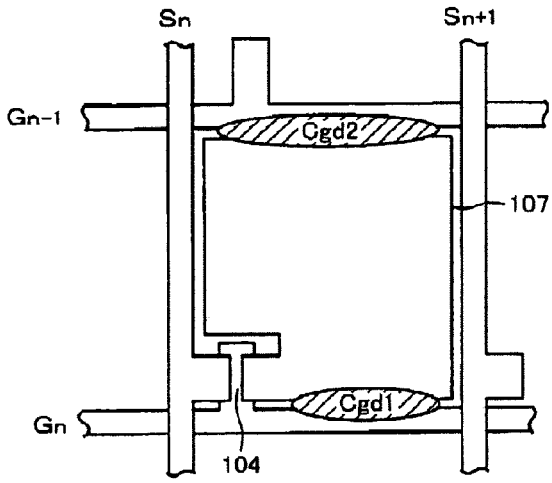
FIG. 7 is a plane view illustrating that parasitic capacitances occur in the liquid crystal display device illustrated in FIG. 6.
Figure 8:
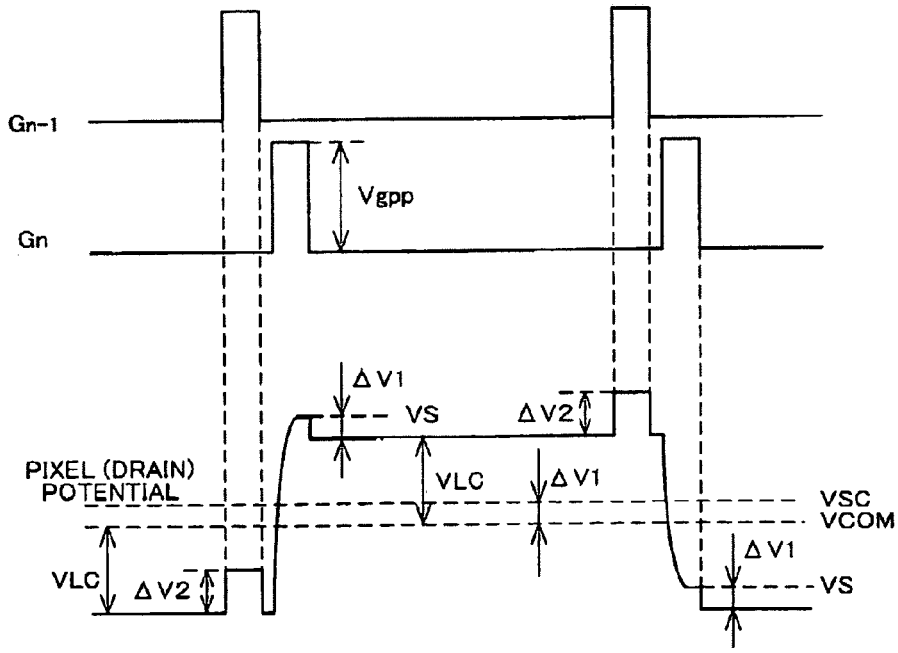
FIG. 8 is a voltage waveform chart illustrating changes of a pixel electrode potential due to the parasitic capacitances generated in the liquid crystal display device illustrated in FIG. 6.
Figure 9:
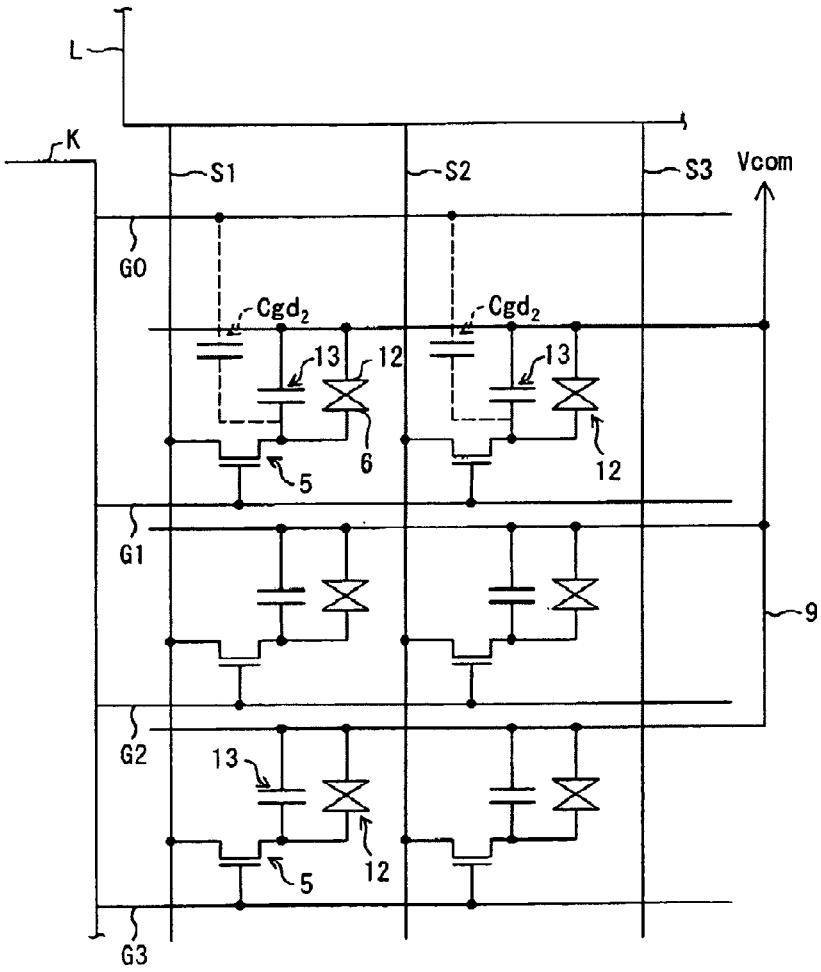
FIG. 9 is a circuit diagram illustrating a configuration of a liquid crystal display device according to Patent Literature 1.
Figure 10:
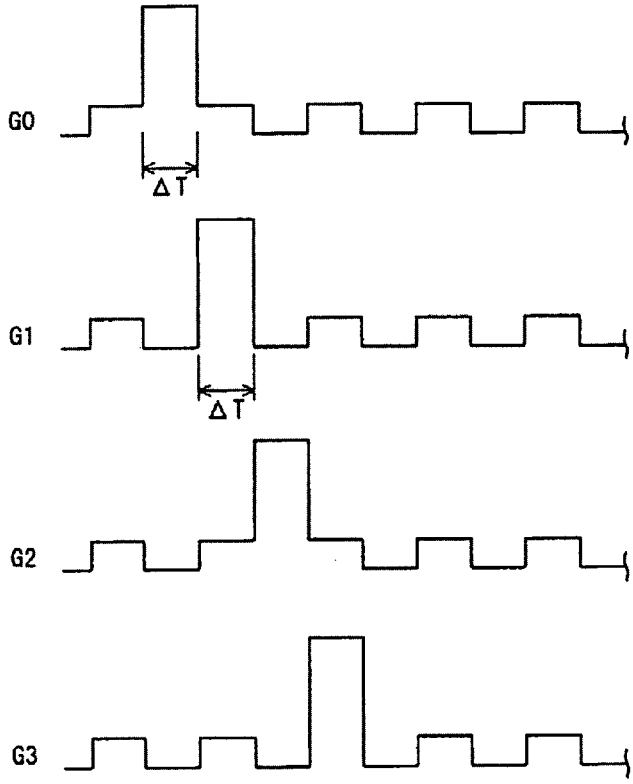
FIG. 10 is a timing chart of signals respectively inputted into a dummy line and gate lines of the liquid crystal display device illustrated in FIG. 9.
Figure 11:
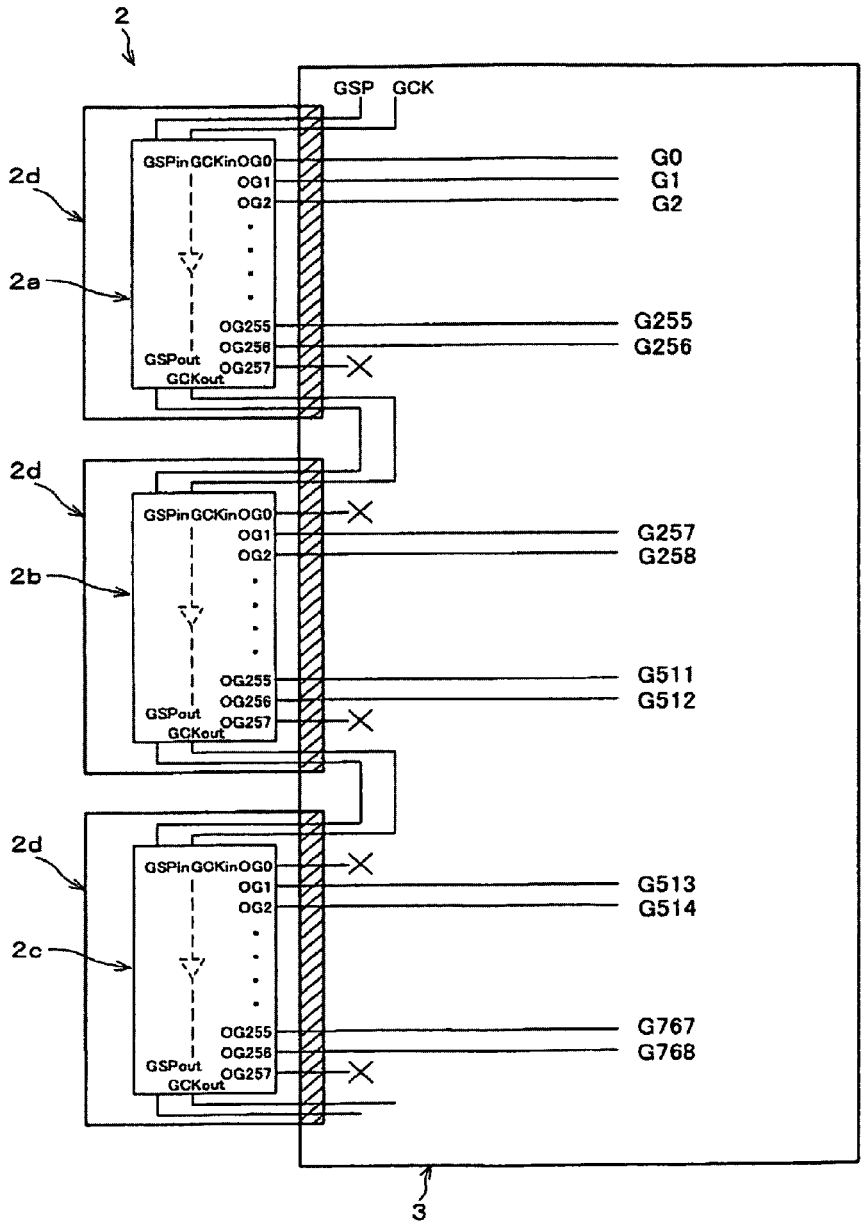
FIG. 11 is a plane view schematically illustrating a configuration of a gate driver of the liquid crystal display device according to Patent Literature 2.
Figure 12:
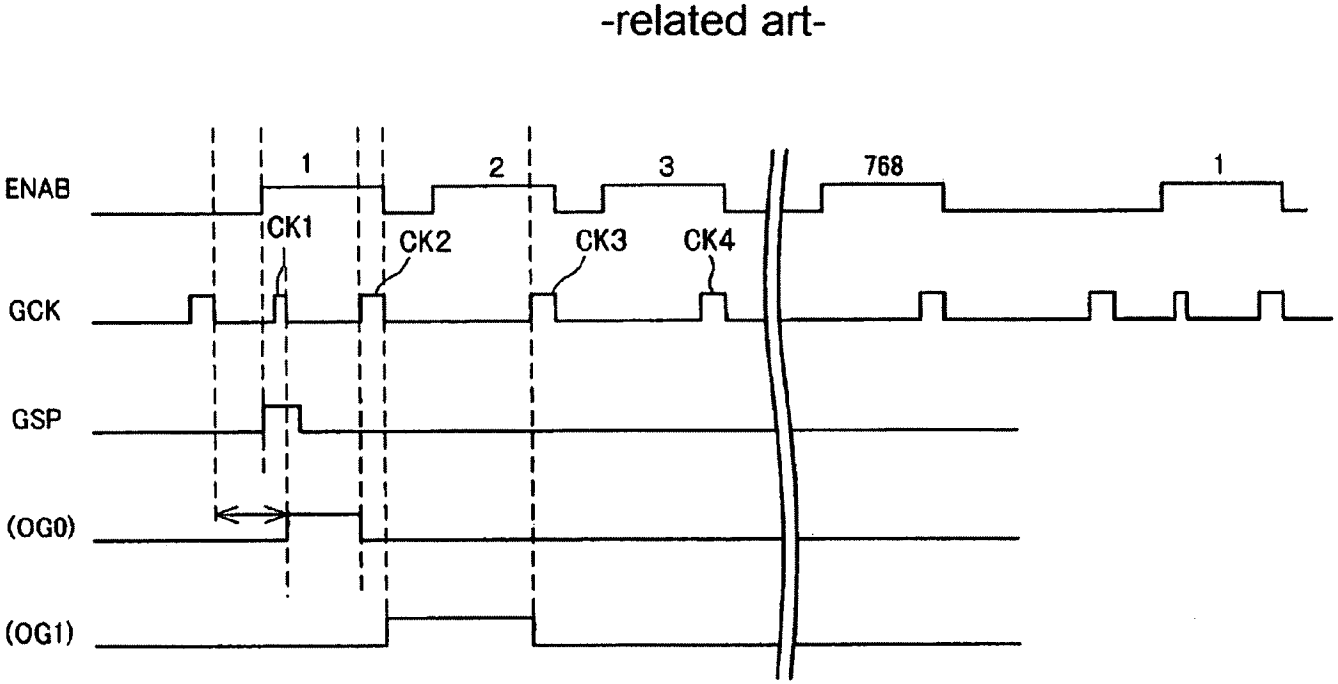
FIG. 12 is a timing chart of respective signals involved in timing control of the liquid crystal display device illustrated in FIG. 11.
Figure 13:
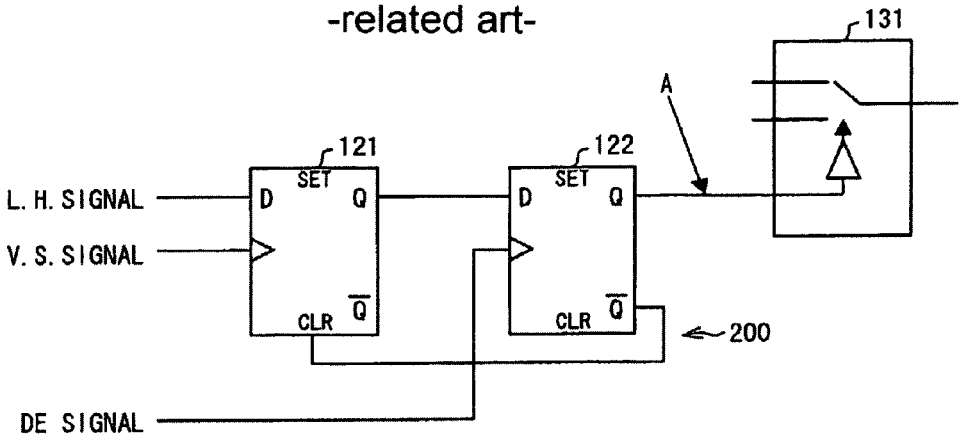
FIG. 13 is a circuit diagram illustrating a configuration of a dummy signal generation circuit according to Patent Literature 2.
Figure 14:
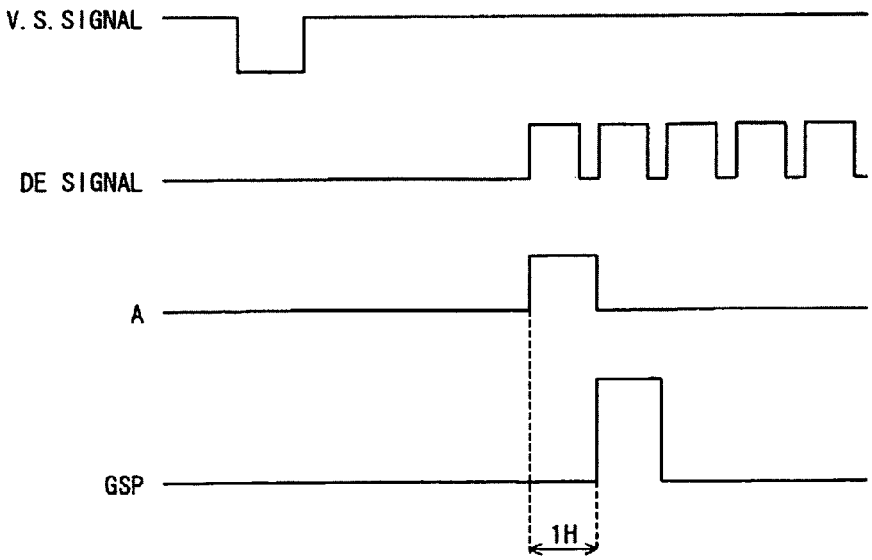
FIG. 14 is a timing chart of respective signals relevant to the dummy signal generation circuit illustrated in FIG. 13.
Figure 15:
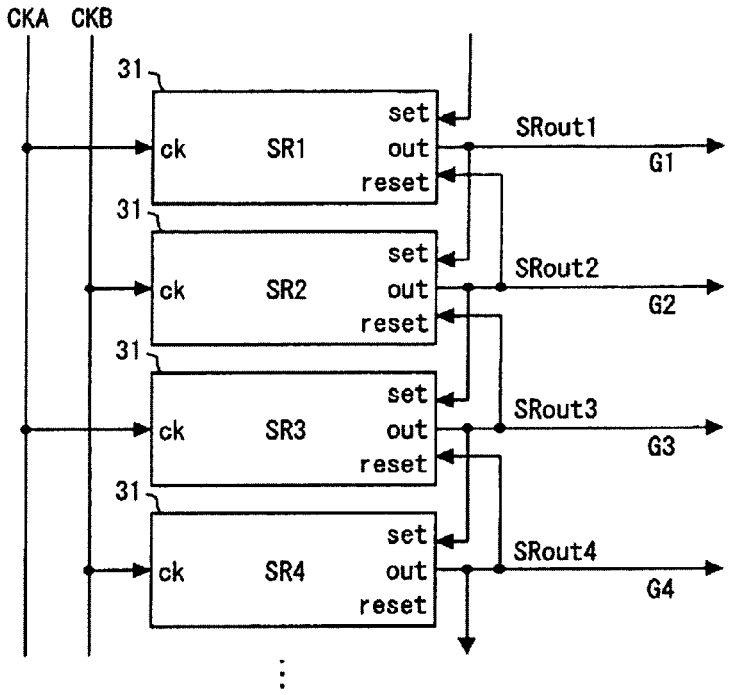
FIG. 15 illustrates an example of a configuration of a shift register constituting a conventional gate driver formed by monolithic integration.

In such a liquid crystal display device, there is no gate line G0 of a preceding stage which produces the parasitic capacitance Cgd2 in each of the pixels P of the first row (FIG. 6), as described in the foregoing description in the section of "Background Art". For this reason, ΔV2 does not occur in the pixels P of the first row. This causes only the pixels P of the first row to have a lower effective value of a voltage to be applied to the liquid crystals as compared to effective values of voltages applied to the respective pixels P of the other rows. Therefore, in a case where a driving condition of the display device deteriorates, for example, in a case where the ΔV2 is large or in a case where a temperature becomes too high or low, brightness of only the pixels P of the first row appears different from brightness of the other pixels P. In view of this problem, conventional techniques prevent deterioration of display quality by providing a dummy gate line (dummy line, dummy scanning signal line) corresponding to the gate line G0. However, according to the conventional techniques, the provision of the dummy line causes various problems (e.g., an increase in cost, an increase in circuit area, and/or deterioration in functionality that should be provided by a dummy line).

In order to solve these problems, as illustrated in FIG. 1, the liquid crystal display device of the present embodiment is provided with a dummy line (dummy scanning signal line) corresponding to the pixels P in the first row. Further, this dummy line is driven by a gate start pulse GSP outputted from the control device 40. A more detailed configuration of the liquid crystal display device 1 is described as below with reference to FIG. 3.

Figure 3:
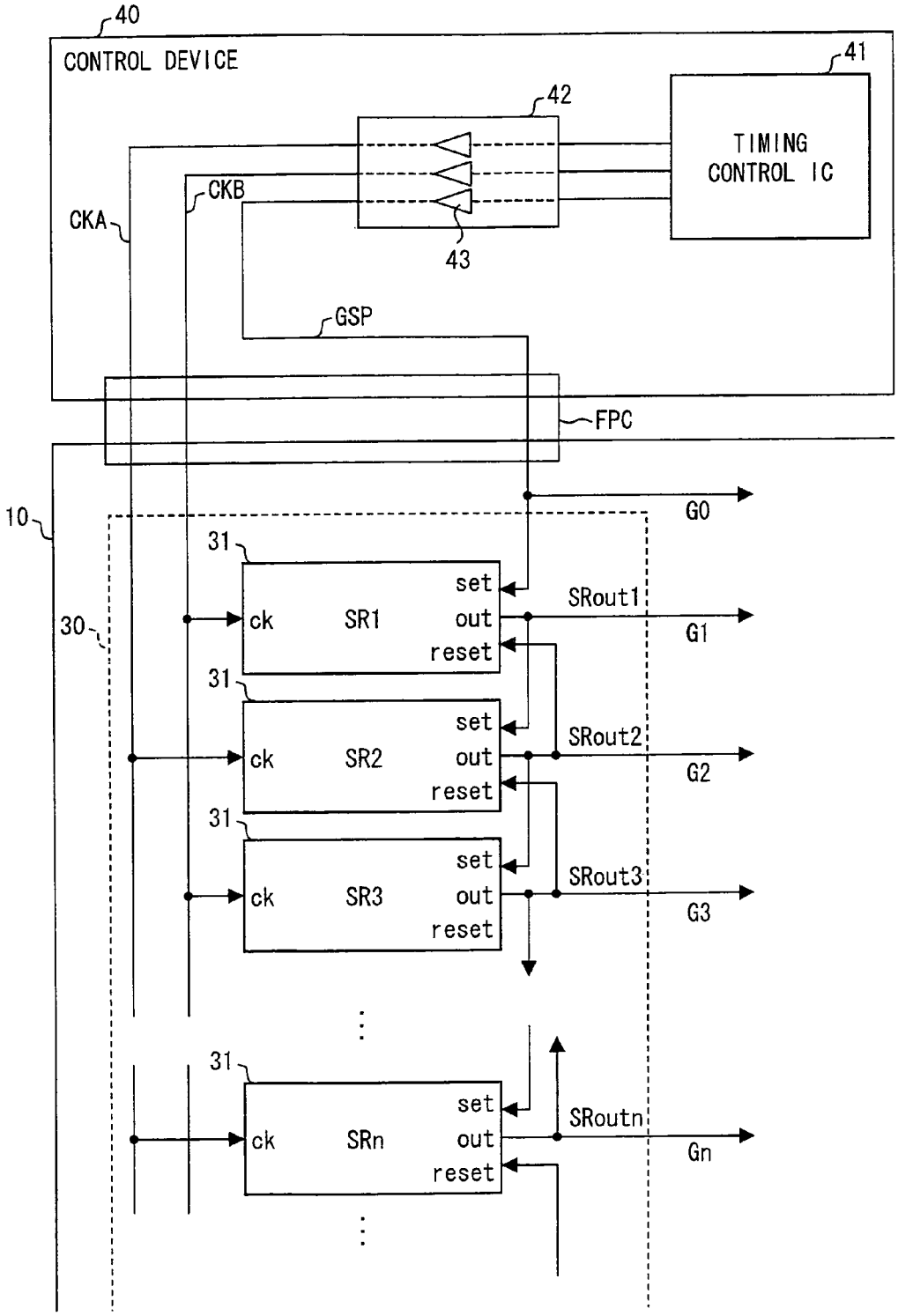
FIG. 3 is a block diagram illustrating a configuration of a gate driver and a control device in the liquid crystal display device illustrated in FIG. 1.

FIG. 3 is a block diagram illustrating a configuration of the gate driver 30 and the control device 40.

First, the configuration of the gate driver 30 is described. The gate driver 30 includes a plurality of shift registers 31. For the sake of convenience in explanation, hereinafter, each shift register 31 is also referred to as a shift register stage 31. In such a case, a plurality of cascade-connected shift register stages 31 are collectively termed "shift register".

Each shift register stage 31 includes a set input terminal set, a reset input terminal reset, an output terminal out, and a clock input terminal ck. An n-th (n=1, 2, 3, . . . ) shift register stage 31 is referred to as SRn, and an output signal outputted from the output terminal out of the SRn is referred to as SRoutn. Each shift register stage 31 denoted by SRn drives a corresponding gate line Gn according to the output signal SRoutn. Into the set input terminal set of the first shift register stage 31, a gate start pulse GSP is inputted.

The output terminal out of each shift register stage 31 is connected to the set input terminal set of a subsequent, i.e., (n+1)th shift register stage 31 and the reset input terminal reset of a preceding, i.e., (n−1)th shift register stage 31. That is, the output signal SRout outputted from the output terminal out of each shift register stage 31 serves as a set signal of the subsequent shift register stage 31 and a reset signal of the preceding shift register stage 31.

Into the clock input terminals ck of either one of odd-numbered shift register stages 31 and even-numbered shift register stages 31, a clock signal CKB is inputted. Into the clock input terminals ck of the other one of the odd-numbered shift register stages 31 and the even-numbered shift register stages 31, a clock signal CKA is inputted. The clock signals CKA and CKB are in such a relation that they have the same periods but an active period, that is, the high-level period, of the clock signal CKA does not overlap with an active period of the clock signal CKB.

Each of the gate lines Gn is connected to a corresponding shift register stage 31. In a preceding stage to the first gate line G1, a dummy line G0 is provided so as to be parallel to the gate line G1. The dummy line G0 is connected to the control device 40 via a signal line for the gate start pulse GSP. In this configuration, the first gate line G1 is driven by an output signal SRout 1 outputted from the output terminal out of the first shift register stage 31, while the dummy line G0 is driven by the gate start pulse GSP outputted from the control device 40.

The following describes a configuration of the control device 40. It is preferable that the gate start pulse GSP, which is outputted from the control device 40, has a voltage level at which the dummy line G0 can be driven. Specifically, it is preferable that the gate start pulse GSP has a voltage level at which TFTs can be turned on/off. Further, it is more preferable that the voltage level of the gate start pulse GSP is the same as the voltage level at which a voltage is applied to the gate line Gn.

In view of this, in the liquid crystal display device 1 according to the present embodiment, the control device 40 includes a timing control IC 41 that generates the clocks and the gate start pulse, and a level shifter 42 that converts a supply voltage level. The level shifter 42 includes buffers 43 each of which outputs an amplified signal in response to an inputted signal. The gate start pulse outputted from the timing control IC 41 is converted by the level shifter 42 so as to have a desired voltage level, and then inputted into the dummy line G0 and the first shift register stage 31.

With this configuration, the level shifter 42 shifts respective levels of the logic signals CKA, CKB, and GSP, which are generated by the timing control IC 41 and have a TTL level, so that each of the levels of the logic signals CKA, CKB, and GSP becomes a DC level (e.g., High level: 20V and Low level: −10V) at which the shift register and the gate lines Gn can be driven. The gate start pulse GSP whose level is shifted is applied to the dummy line G0. The level shifter 42 includes the output buffers 43 that are capable of sufficiently driving the gate lines Gn. Among the output buffers 43, an output buffer 43 for the gate start pulse line is capable of driving both the first shift register 31 and the dummy line G0. In the conventional techniques, a current that had a peak value of approximately 1 mA was inputted into the first shift register. In contrast, with the structure according to the present invention in which the first shift register stage 31 and the dummy line G0 are driven at the same time, in a case of a display panel that has a size of approximately 12 inches, for example, a current that has a peak value of approximately 30 mA is inputted into the first shift register stage 31 and the dummy line G0.

As described above, in the liquid crystal display device 1 according to the present embodiment, the dummy line G0 is provided in the preceding stage to the first gate line G1. The dummy line G0 is driven by the gate start pulse GSP that is outputted from the control device 40 and that is inputted into the first shift register stage 31. The voltage level of the gate start pulse GSP is set by a buffer or the like to a voltage level at which each of the gate lines can be driven.

The dummy line G0 is preferably arranged so as to sandwich the pixel electrodes 12 in the first row between the dummy line G0 and the gate line G1 so that a distance between the dummy line G0 and the gate line G1 is equal to a distance between other two adjacent gate lines (e.g., between the gate lines G1 and G2).

Figure 4:
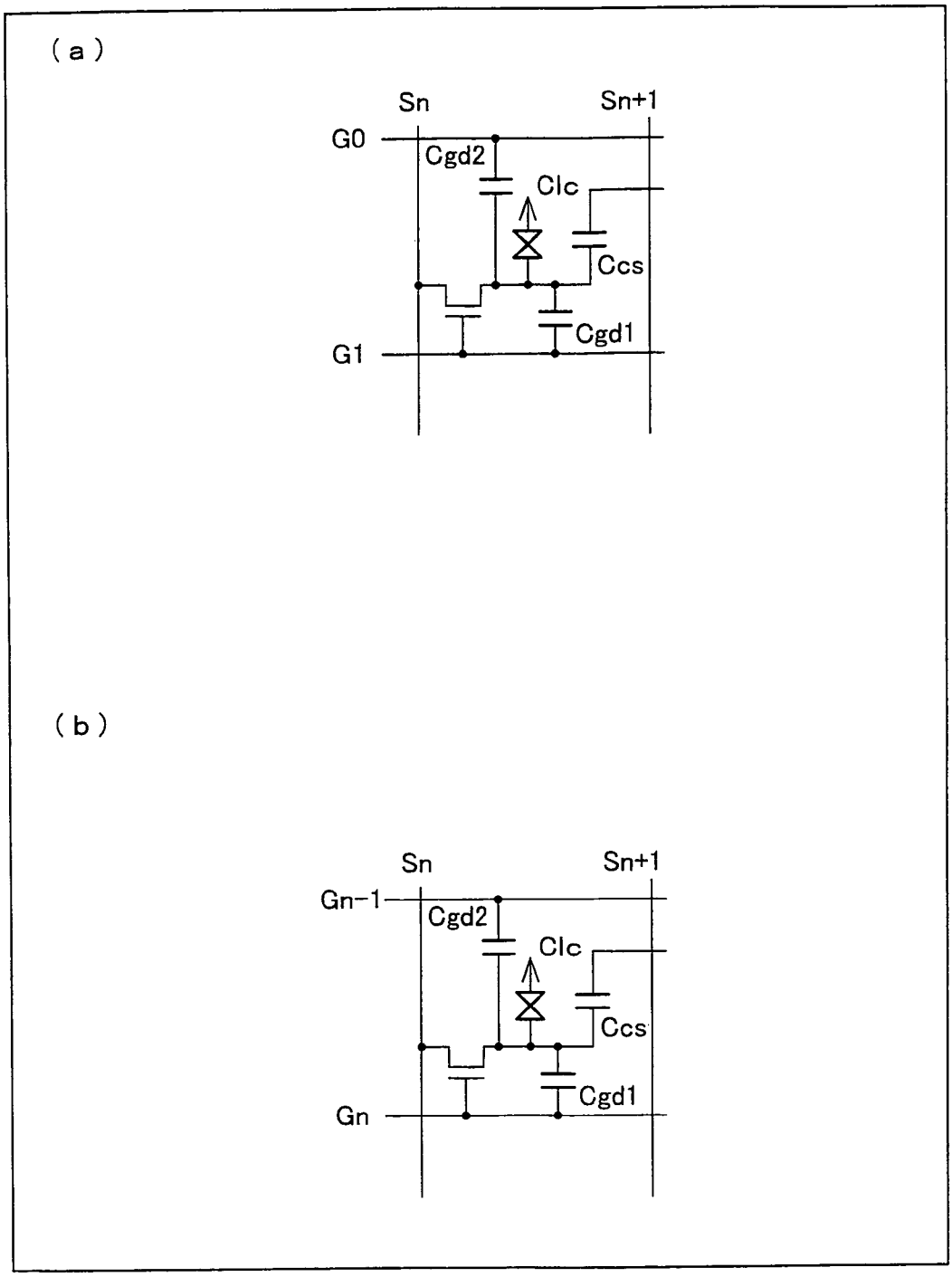
FIG. 4 is an equivalent circuit diagram illustrating electrical configurations of pixels of the liquid crystal display device illustrated in FIG. 1. (a) of FIG. 4 illustrates an electrical configuration of a pixel in the first row, and (b) of FIG. 4 illustrates an electrical configuration of a pixel in the second and subsequent rows.

With this configuration, as shown in FIG. 4, the pixel electrode 12 connected to the TFT 11 connected to the top gate line G1 is sandwiched between the dummy line G0 above and the gate line G1 below. As a result, all of the pixels P are geometrically symmetrical in a vertical direction. Therefore, conditions of the pixels P ((a) of FIG. 4) driven by the top gate line G1 can become completely the same as conditions of the pixels driven by the other gate lines G2, G3, . . . . Consequently, for example, in a case of a normally white mode, it is possible to restrain such a phenomenon that a line of pixels P in the top row appears a bright line.

In addition, with the above configuration, the signal outputted from the control device 40 directly drives the dummy line G0. Further, this signal outputted from the control device 40 is inputted to the first shift register as a gate start pulse GSP. Thus, the dummy line G0 can be used also as the gate start pulse line. This makes it possible to reduce the number of wirings. Moreover, in the above configuration, it is not necessary to provide the shift register stage 31 corresponding to the dummy line G0. This makes it possible to reduce a circuit area.

Furthermore, with the above configuration, the gate start pulse GSP can be used as a driving signal for the dummy line G0. As such, unlike the conventional techniques employing a data enable mode, it is not necessary to shorten a pulse width of the signal for driving the dummy scanning signal line G0 in the above configuration. This makes it possible to sufficiently charge the pixels corresponding to the dummy scanning signal line G0, and therefore to attain an even display.

Figure 16:
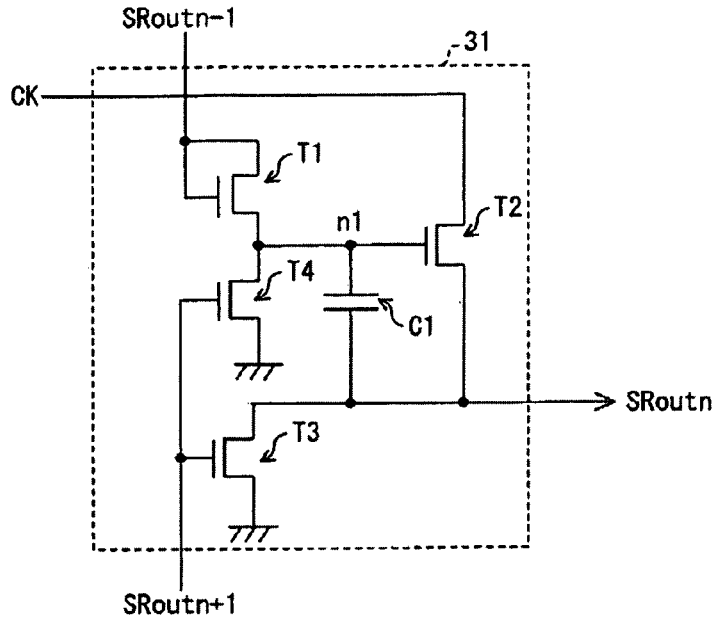
FIG. 16 is a circuit diagram of a shift register stage constituting the shift register illustrated in FIG. 15.
Figure 17:
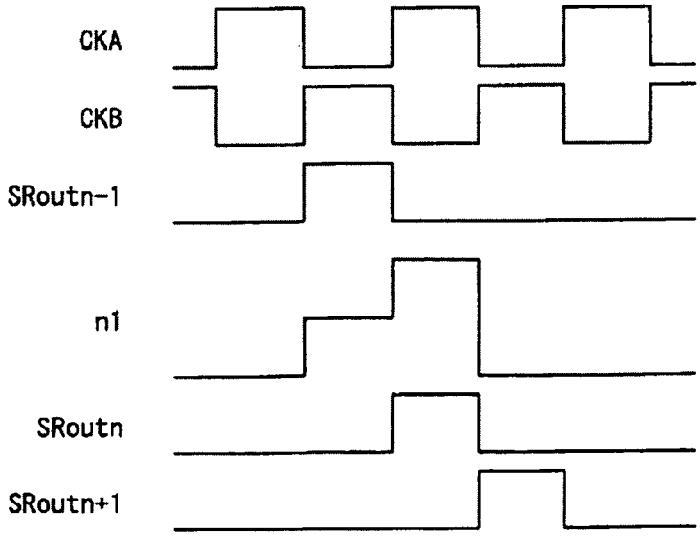
FIG. 17 is a timing chart showing waveforms of various signals in the shift register stage illustrated in FIG. 16.
Figure 18:
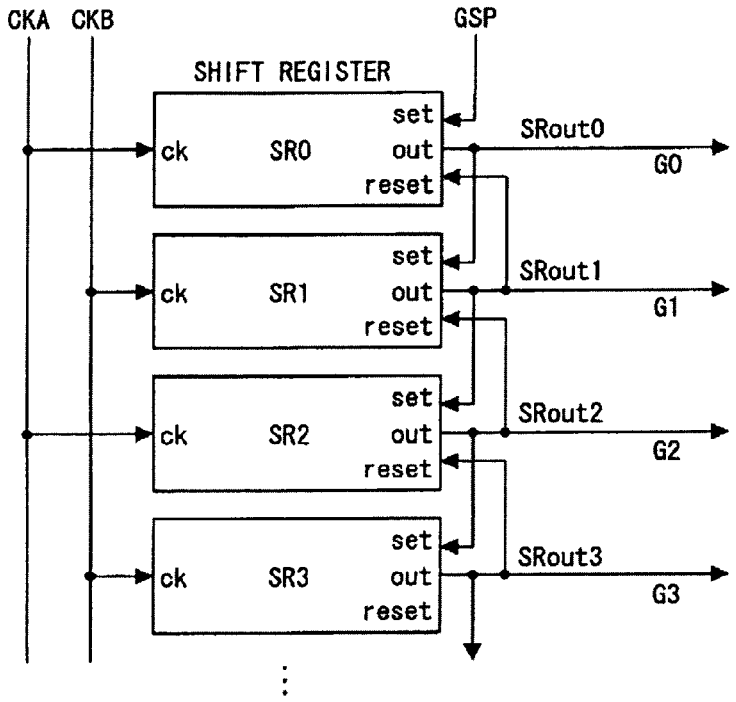
FIG. 18 is an example of a configuration in which a dummy line is provided in the gate driver illustrated in FIG. 15.

As a specific configuration of the shift register stage 31, a conventionally well-known configuration illustrated in FIG. 16 may be employed.

As illustrated in FIG. 16, each shift register stage 31 includes, for example, a capacitor C1 and transistors T1 to T4 each of which is made up of an n-channel (or p-channel) TFT.

A gate and a drain of the transistor T1 is connected to the set input terminal set. A gate of the transistor T2 is connected to a source of the transistor T1. A drain of the transistor T2 is connected to the clock input terminal ck, and a source of the transistor T2 is connected to the output terminal out. A gate of the transistor T3 is connected to the reset input terminal reset. A drain of the transistor T3 is connected to the output terminal out, and a source of the transistor T3 is connected to a low-potential supply VSS. A gate of the transistor T4 is connected to the reset input terminal reset and the gate of the transistor T3. A drain of the transistor T4 is connected to the source of the transistor T1 and the gate of the transistor T2, and a source of the transistor T4 is connected to the low-potential supply VSS. Between the output terminal out and a connection point of the transistors T1, T2, and T4 (a node n1), the capacitor C1 is connected.

When a clock CK, an output signal SRoutn−1 of the (n−1) th shift register stage 31, and an output signal Sroutn+1 of the (n+1)th shift register stage 31 are inputted into the n-th shift register stage 31, the n-th shift register stage 31 outputs an output signal SRout to the (n−1)th and (n+1)th shift register stages 31 and the gate line Gn.

Figure 5:
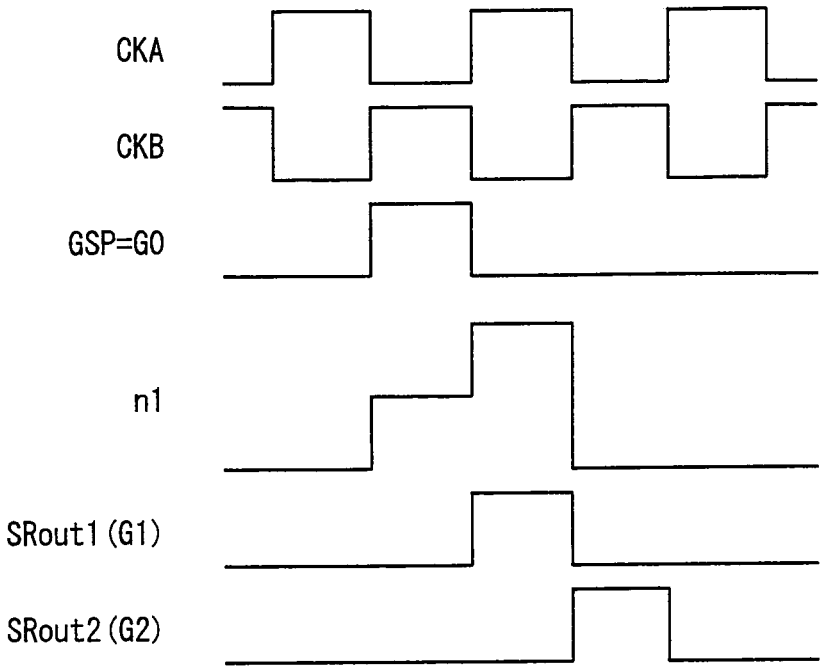
FIG. 5 is a timing chart illustrating waveforms of various signals in a shift register stage constituting a shift register included in the gate driver illustrated in FIG. 3.

FIG. 5 is a timing chart illustrating waveforms of various signals in the shift register stage 3*a* illustrated in FIG. 3.

Figure 19:
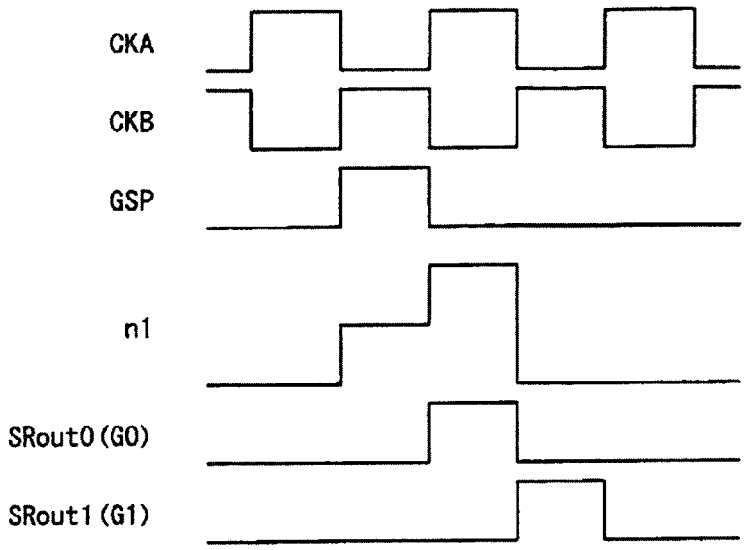
FIG. 19 is a timing chart illustrating waveforms of various signals in shift register stages illustrated in FIG. 18.

It is clear from the timing chart of FIG. 5 that, according to the configuration of the present embodiment, a gate start pulse GSP is directly inputted into the dummy line G0. Therefore, unlike the conventional techniques, it is not necessary in the configuration of the present embodiment to generate a signal at a timing prior to the driving of the dummy line G0 (FIG. 19). This makes it possible to ensure a sufficient pulse width of the signal (GSP) for driving the dummy line G0. Consequently, the pixels corresponding to the dummy line G0 can be sufficiently charged. This makes it possible to perform an even display even in an outermost line in the display area of the liquid crystal display panel.

In the liquid crystal display device of the present embodiment, the gate start pulse GSP for driving the dummy line G0 is provided from an outside of the gate driver 30. On this account, the liquid crystal display of the present embodiment is particularly suitable for monolithic integration according to which the gate driver is formed on the panel with use of amorphous silicon. The liquid crystal display panel that has been monolithically formed may be connected with the control device via an FPC (flexible printed circuit board), as illustrated in FIG. 1. This makes it also possible to reduce cost for the liquid crystal display device. It should be noted that the gate driver and the control device of the above liquid crystal display device can also be applied to conventionally common liquid crystal display devices that are not monolithically structured.

The present invention is not limited to the description of the embodiments above, but may be altered within the scope of the claims. An embodiment based on a proper combination of technical means disclosed in different embodiments is encompassed in the technical scope of the present invention.

INDUSTRIAL APPLICABILITY

The present invention has such a configuration that the dummy line is driven by a gate start pulse at a predetermined voltage level. Therefore, the present invention is suitably applied in particular to a display device in which a gate driver is monolithically integrated.

The invention claimed is:

1. A display device comprising:

a display panel including:

scanning signal lines;

data signal lines;

pixel electrodes; and switching elements, each of the switching elements having (i) one terminal connected with one of the pixel electrodes and (ii) another terminal connected with one of the data signal lines, each of the scanning signal lines turning on/off switching elements corresponding thereto, the each scanning signal line forming one of rows together with the switching elements connected thereto, and pixel electrodes respectively connected to these switching elements;

a scanning signal line driving circuit including a plurality of shift registers each provided so as to correspond to each of the rows, the scanning signal line driving circuit outputting a scanning signal for turning on the switching elements in the each row;

a data signal line driving circuit outputting a data signal in accordance with an image to be displayed;

a dummy scanning signal line provided for an outermost row located at an outermost position from which scanning by use of the scanning signal starts, the dummy scanning signal line being driven by a gate start pulse inputted into a shift register corresponding to the outermost row located at the outermost position, the gate start pulse driving the dummy scanning signal line has a voltage level allowing the switching element to be turned on/off, the gate start pulse driving the dummy scanning signal line is set at the voltage level by a buffer; and a control device generating the gate start pulse and a clock for driving the scanning signal line driving circuit, the control device including the buffer for generating the gate start pulse, the dummy scanning signal line is connected to a signal line connecting the control device with the scanning signal line driving circuit; and the gate start pulse is inputted into the scanning signal line driving circuit and the dummy scanning signal line via the signal line.

2. The display device according to claim 1, wherein:

the dummy scanning signal line is arranged so as to sandwich pixel electrodes in the outermost row between the dummy scanning signal line and a scanning signal line in the outermost row so that a distance between the dummy scanning signal line and the scanning signal line in the outermost row is equal to a distance between other two adjacent scanning signal lines, the outermost row located at the outermost position.

* * * * *